US007292804B2

(12) United States Patent
Preston et al.

(10) Patent No.: US 7,292,804 B2
(45) Date of Patent: Nov. 6, 2007

(54) METHODS AND SYSTEMS FOR MOUNTING AN IMAGING MEDIA CARTRIDGE TO A PRINTER

(75) Inventors: Todd K Preston, Greece, NY (US); Richard A Kalb, Greece, NY (US); James J Spence, Honeoye Falls, NY (US)

(73) Assignee: Xerox Corporation, Stamford, CT (US)

( * ) Notice: Subject to any disclaimer, the term of this patent is extended or adjusted under 35 U.S.C. 154(b) by 137 days.

(21) Appl. No.: 11/167,256

(22) Filed: Jun. 28, 2005

(65) Prior Publication Data

US 2006/0291899 A1 Dec. 28, 2006

(51) Int. Cl.
*G03G 15/00* (2006.01)
*G03G 21/16* (2006.01)

(52) U.S. Cl. ..... 399/110; 399/111

(58) Field of Classification Search ..... 399/126, 399/112, 114

See application file for complete search history.

(56) References Cited

U.S. PATENT DOCUMENTS 5,296,894 A * 3/1994 Green et al. ..... 399/73
5,930,561 A * 7/1999 Hosokawa et al. ..... 399/111
7,072,602 B2 * 7/2006 Hatori et al. ..... 399/111
7,127,194 B2 * 10/2006 Hoshi et al. ..... 399/111
2001/0055498 A1 * 12/2001 Matsuzaki et al. ..... 399/111
2005/0220481 A1 * 10/2005 Yamaguchi et al. ..... 399/111

* cited by examiner

*Primary Examiner*—David M. Gray
*Assistant Examiner*—David A Blackshire
(74) *Attorney, Agent, or Firm*—Oliff & Berridge, PLC

(57) ABSTRACT

A printing system that receives an imaging media cartridge includes a rail and a dock to install the imaging media cartridge. The imaging media cartridge includes a housing that has pivots along an alignment axis substantially parallel to the rail. The imaging media cartridge further includes a roller that slides along the rail, the roller being disposed on the housing. The imaging media cartridge also includes a bracket disposed on the housing. To insert the bracket into the dock, the housing rotates on the pivots. To further adjust the position of the imaging media cartridge in the xerographic system, the housing rotates along at least one axis substantially orthogonal to the alignment axis. The rail includes a support beam and a flange. The roller includes at least a pair of wheel housings, each wheel housing having a pair of tandem wheels that glide along the rail. The tandem wheels face each other and glide along the flange and between the support beam. The imaging media cartridge includes a pair of magazines that contains the pivots, with the pair of magazines being disposed in the pair of wheel housings. The bracket includes at least one wheel to glide into the dock.

19 Claims, 8 Drawing Sheets

METHODS AND SYSTEMS FOR MOUNTING AN IMAGING MEDIA CARTRIDGE TO A PRINTER

BACKGROUND

This invention relates to alignment and attachment mechanisms for removably mounting an imaging media cartridge in a printer.

Production-level high-end printer, such as the iGen printing press may include a customer changeable unit (CCU) to supply and/or develop imaging media corresponding to a customized color. Such imaging media may include dry toner or liquid ink. The CCU may include, for example, an imaging media dispenser as well as a developer, particularly for a toner and integrated together in an imaging media cartridge.

The imaging media may correspond to a standard set of colors that include cyan, magenta, yellow and black (CMYK) in the four standard imaging media stations may be augmented by a trademarked color heavily used by a printer client for high quality publications.

Such trademarked colors may be assigned a corresponding four-digit PANTONE® number and assigned to a fifth imaging media station. Upon completion of a print run for one printer client using a first CCU having imaging media in a first trademarked color, the first CCU may be removed and replaced by a second CCU having imaging media in a second trademarked color for another printer client. Alternatively, the CCU in the fifth imaging media station may be assigned to a heavily used color of the CMYK set.

The CCU may be integrally designed and constructed and weigh between ~30 and ~40 pounds-mass. The CCU may be installed into a right side Xerographic-tower (or X-tower) of the iGen printing press as a consequence of overlapping design constraints. Close tolerances may be imposed for installing the mounted CCU in order to avoid misalignment of its imaging media dispensing and/or developing equipment.

SUMMARY

Various exemplary embodiments provide a printing system that may receive an imaging media cartridge including a rail and a dock to install the imaging media cartridge. The imaging media cartridge may include a housing that has pivots along an alignment axis substantially parallel to the rail. The imaging media cartridge may further include a roller that slides along the rail, with the roller being disposed on the housing. The imaging media cartridge also may include a bracket disposed on the housing. To align and insert the bracket into the dock, the housing may rotate on the pivots.

In various exemplary embodiments, the position of the imaging media cartridge may be further adjusted in the xerographic system. The housing may rotate along at least one axis substantially orthogonal to the alignment axis. The rail may include a support beam and a flange. The roller may include at least a pair of wheel housings, each wheel housing having a pair of tandem wheels that glide along the rail.

In various exemplary embodiments, the tandem wheels in the wheel housing may face each other and glide along the flange and between the support beam. The imaging media cartridge may include a pair of magazines that contains the pivots, with the pair of magazines being disposed in the pair of wheel housings. The bracket may include at least one wheel to glide into the dock.

BRIEF DESCRIPTION OF THE DRAWINGS

Various details are described below with reference to the following figures, wherein.

DETAILED DESCRIPTION OF EMBODIMENTS

The following detailed description refers to an imaging media cartridge in a printing system, such as a xerographic printer. The imaging media cartridge may refer to customer changeable unit (CCU) used in an iGen printer. However, it should be appreciated that the principles described herein may be equally applied to any known or later-developed imaging media cartridges and printing systems, beyond the examples specifically discussed herein.

Figure 1:
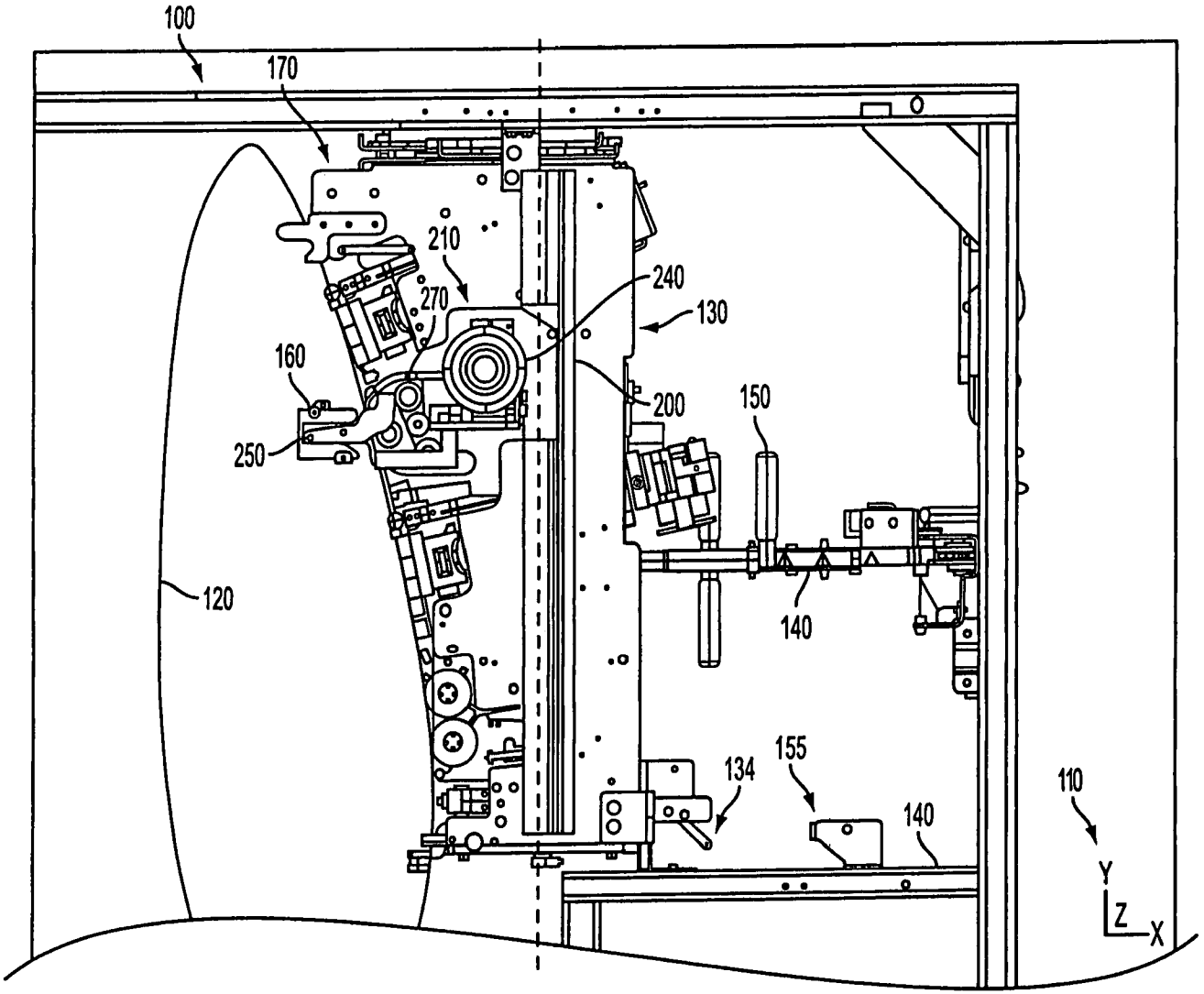
FIG. 1 shows an elevation view of a right X-tower with a CCU.

Xerographic printing may include disposing charged toner particles to a photoreceptor, such as a drum or belt. The photoreceptor represents an intermediate transfer body with which to transfer an image using toner particles to a sheet medium. The toner particles may be composed of pigmented thermoplastic resin. FIG. 1 shows an elevation view of a right X-tower portion 100 of an iGen printer, as seen from the front in the X-Y plane of a global Cartesian coordinate set of orthogonal axes 110. Artisans of ordinary skill will recognize that such examples for printing are also applicable to alternate forms of imaging media besides toner, such as liquid ink.

A photoreceptor belt 120 may travel in a path around stations in the iGen printer. Following the capture of an image to be reproduced, corresponding regions on the photoreceptor belt 120 may be selectively charged to attract the toner particles for transfer to a sheet medium.

The X-tower portion 100 may include a mounting frame 130 onto which a CCU 200 may be installed. The CCU 200 may contain and dispense the toner particles, particularly those corresponding to the customized color. The mounting frame 130 may include an engagement member 134 and may be slidable along one or more lateral rails 140 substantially parallel to the X-axis.

Lateral force may be applied to a closure mechanism 150 connected to the mounting frame 130 for sliding the CCU 200 in the X-direction. The X-tower portion 100 may also include one or more docking blocks 160, with which to align and secure the CCU 200. The closure mechanism (or slider) 150 may include a slider stop 155 to interrupt travel of the mounting frame 130. The docking blocks 160 may be disposed in association with and proximately to (i.e., in proximity of) the photoreceptor belt 120.

Figure 2:
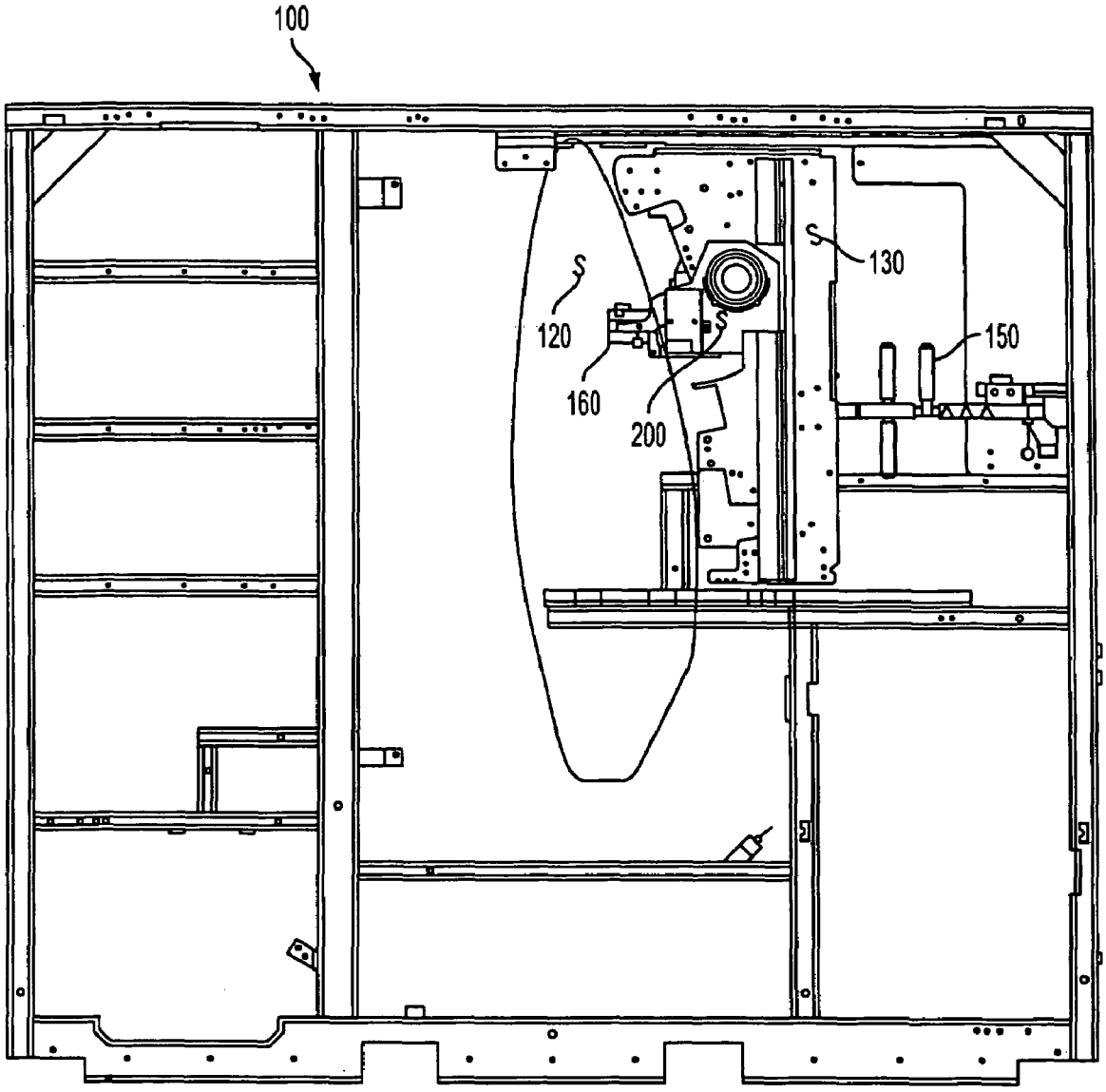
FIG. 2 shows an elevation view of the right X-tower in the operating position.

FIG. 2 shows a simplified elevation view of the X-tower portion 100 in the operating position. During operation of the iGen printer, the CCU 200 may be disposed adjacent to the photoreceptor belt 120 and secured by the docking blocks 160, during which the mounting frame 130 remains in a closed position.

Figure 3:
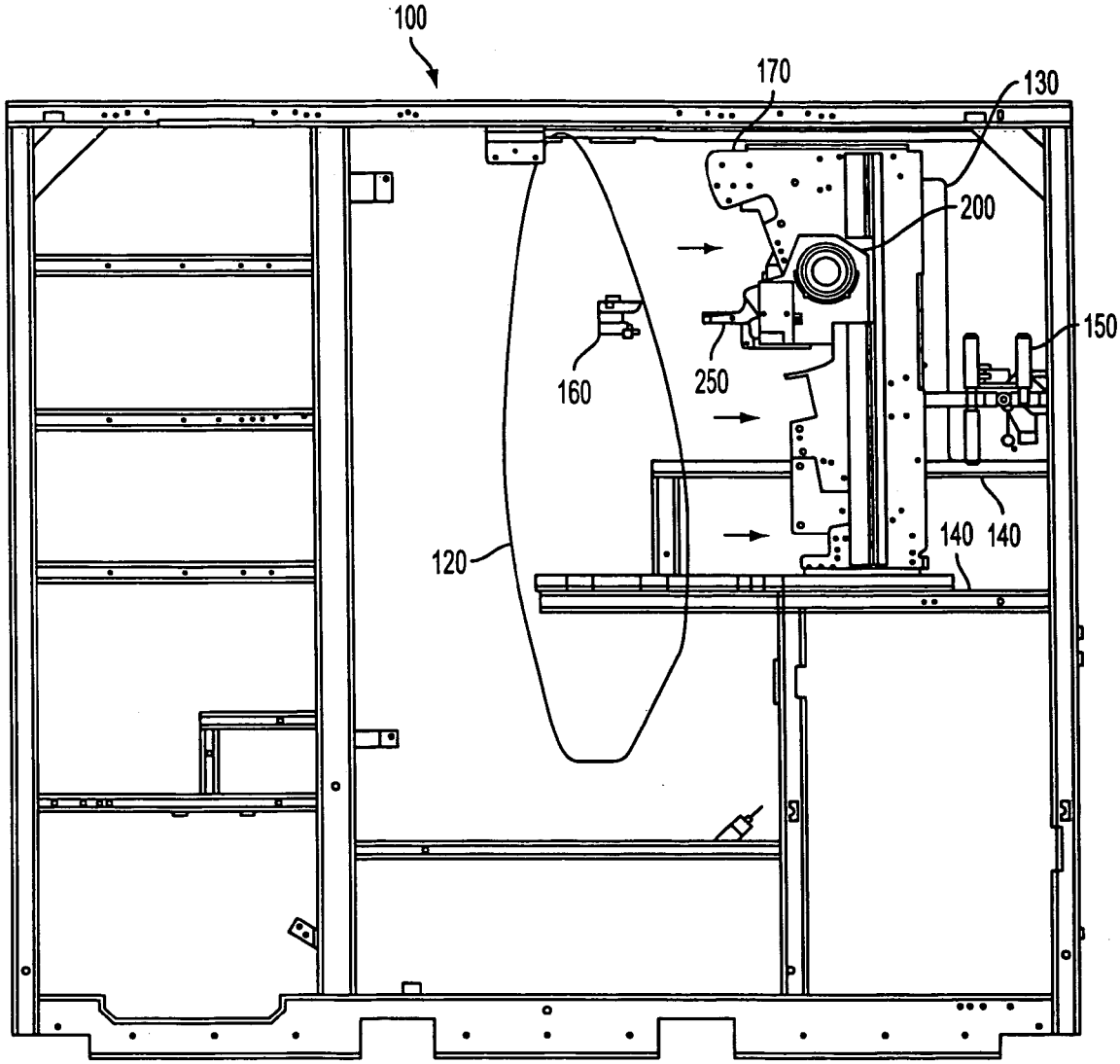
FIG. 3 shows an elevation view of the right X-tower in the opened position.

FIG. 3 shows a simplified elevation view of the X-tower portion 100 in the opened position. Retrieval and removal of the CCU 200 may be performed by sliding the mounting frame 130 along the lateral rails 140 by the closure mechanism 150. The CCU 200 may be installed and/or removed using a loading device, such as an elevating cart. The CCU 200, attached to the mounting frame 130, disconnects from the docking blocks 160 and slides in the X-direction away from the photoreceptor belt 120 to obtain adequate clearance, e.g., 9 inches, for removal of the CCU 200 from the X-tower portion 100. Upon reaching the opened position, the engagement member 134 engages against the slider stop 155 to inhibit further motion in the X-direction.

Figure 4:
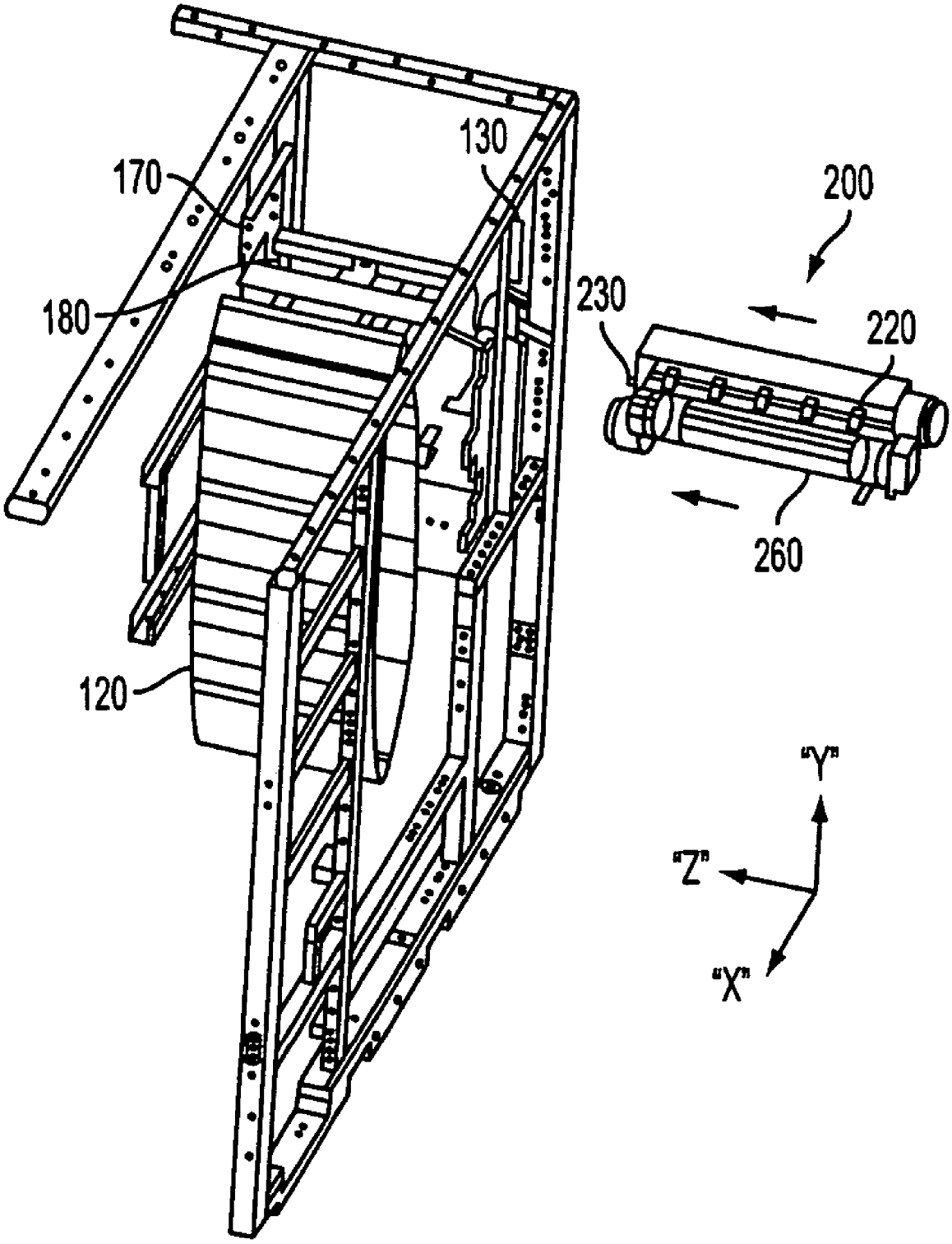
FIG. 4 shows an isometric view of the X-tower in the opened position and the CCU being inserted therein.

FIG. 4 shows a simplified isometric view of the X-tower 100 in the opened position, showing the CCU 200 being inserted into the X-tower 100. A rear plate 170 with alignment holes may be disposed at the rear end of the X-tower 100 and connected to the mounting frame 130. A slider rail 180 extends from the rear plate 170 and may be axially disposed along the Z-direction. The slider rail 180 may be disposed adjacent to the upper end of the photoreceptor belt 120 in conjunction with the mounting frame 130 being in the operating position.

The CCU 200 may include a developer housing 210 and a roller assembly 220 that slides along the slider rail 180 to be disposed in the X-tower 100. The developer housing 210 may include locating pins 230 that insert into corresponding alignment holes in the rear plate 170. The CCU 200 dispenses a quantity of toner, which is electrically charged by a developer to be transferred to a sheet for image reproduction.

Figure 5:
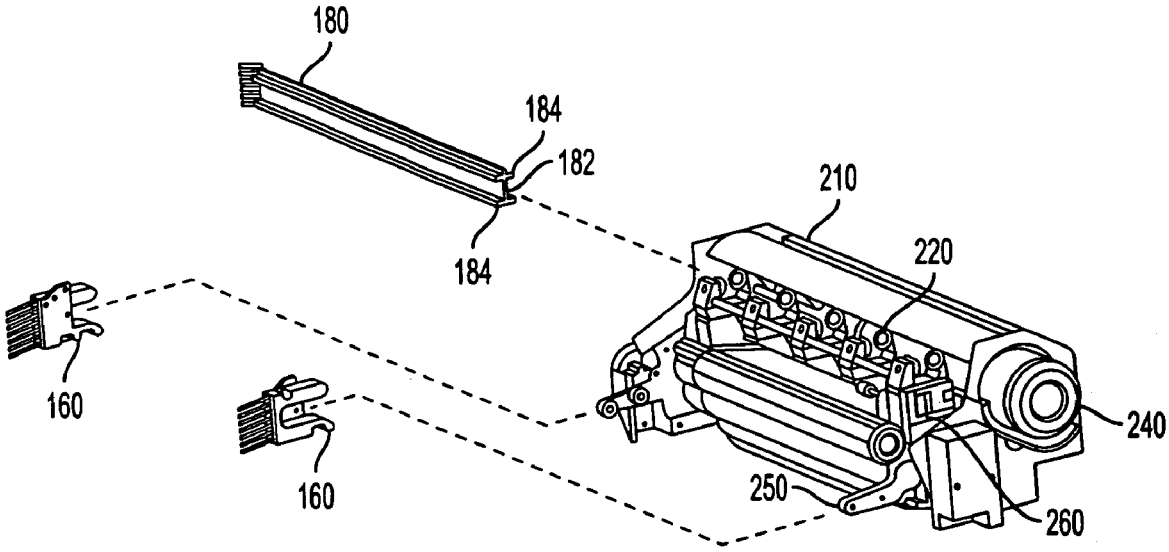
FIG. 5 shows an isometric view of the CCU in association with X-tower mounting components.

FIG. 5 shows an isometric view of the CCU 200 shown in exploded association with selected mounting components of the X-tower, including the slider rail 180 and the docking blocks 160. The slider rail 180 includes a central support beam 182 flanked by upper and lower flanges 184. The CCU 200 includes a toner bottle 240 that contains toner, as well as bracket assemblies 250 that engage the docking blocks 160 and a cradle assembly 260. The roller assembly 220 aligns with and slides along the slider rail 180.

Figure 6:
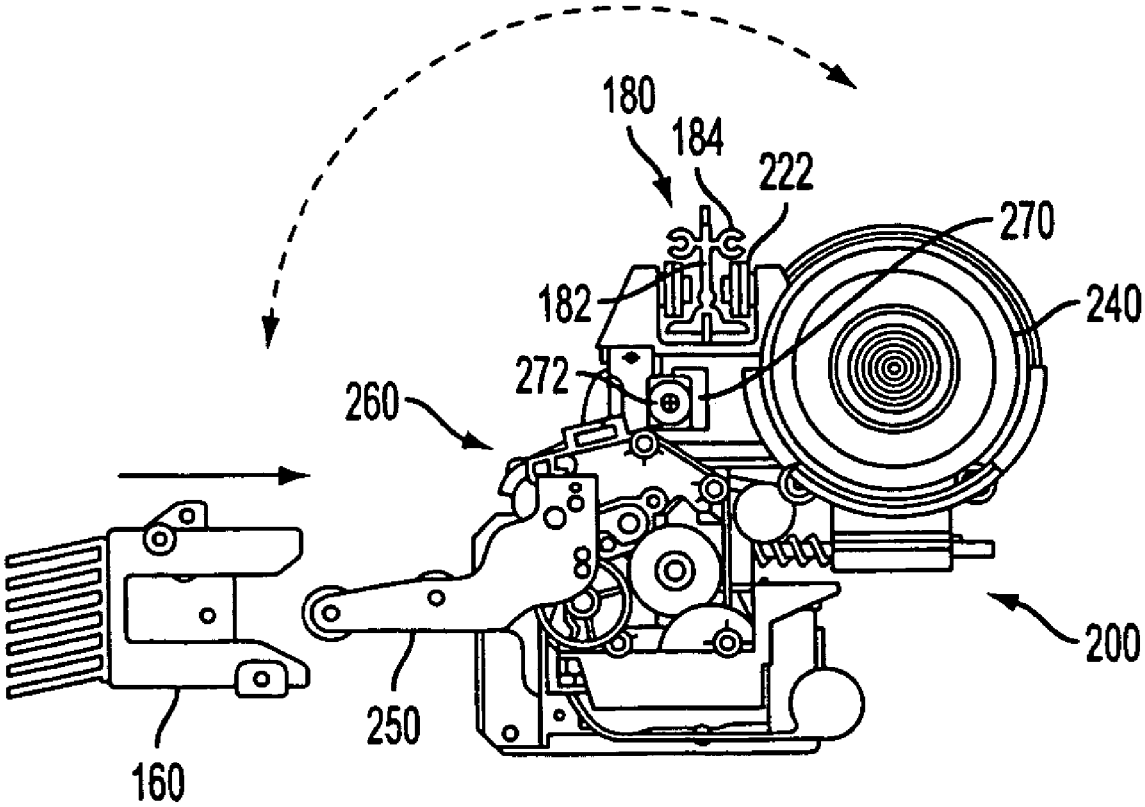
FIG. 6 shows an elevation view of the CCU.

FIG. 6 shows an elevation view of the CCU 200. The roller assembly 220 includes wheels 222 that roll between the flanges 184 of the slider rail 180. The cradle assembly 260 may include magazine assemblies 270 having pivot pins 272 aligned along a pivot axis substantially parallel to the Z-direction. The pivot pins 272 permit the CCU 200 to rotate about the Z-axis for aligning and engaging the bracket assemblies 250 with their corresponding docking blocks 160.

Figure 7:
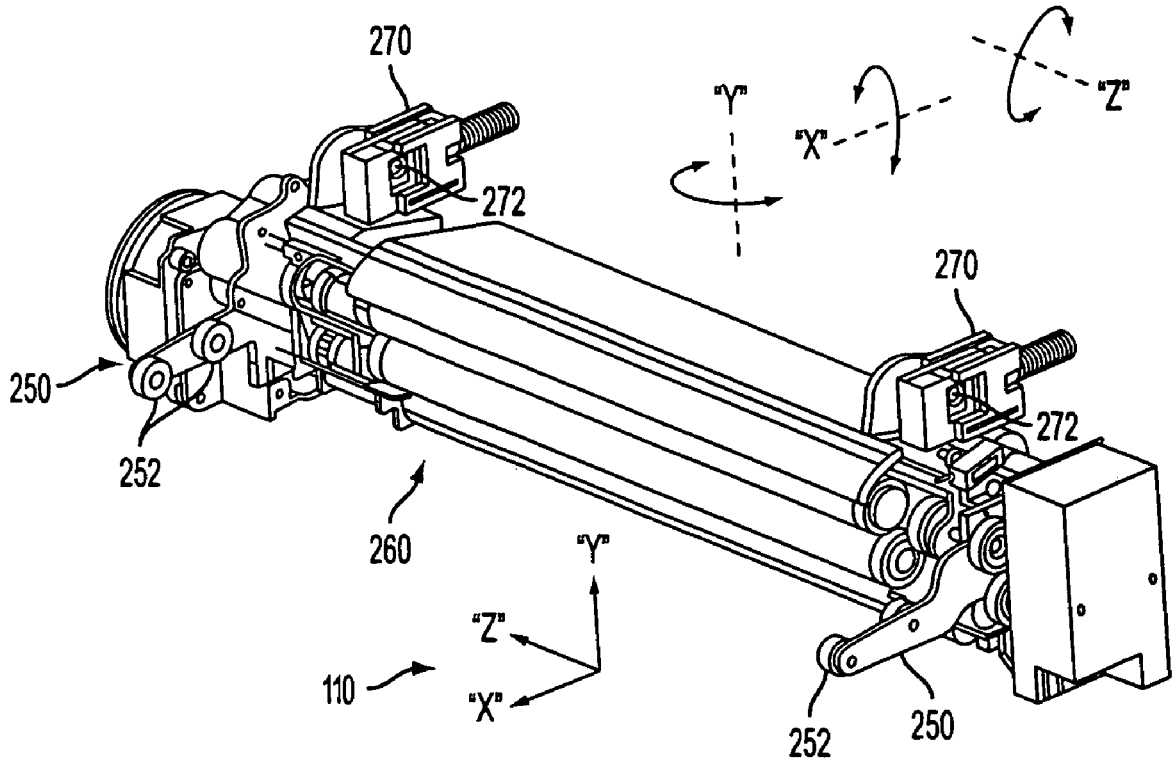
FIG. 7 shows an isometric view of bracket assemblies and a cradle assembly of the CCU.

FIG. 7 shows an isometric view of the bracket assemblies 250 connected to the cradle assembly 260, together with the five degrees of freedom of movement for the CCU 200. The bracket assemblies 250 may each include pairs of wheels 252 to facilitate gliding into the docking blocks 160. The magazine assemblies 270 on which the pivot pins 272 may be connected to the cradle assembly 260.

The CCU 200 may translate along the X- and Y-directions, and rotate about the X-, Y- and Z-axes shown by the coordinate set of axes 110. For aligned mounting into the X-tower portion 100, the CCU 200 may rotate along the Z-axis between three and five degrees (3-5°), such as along an alignment axis corresponding to the pivot pins 272 (and thereby at least approximately parallel to the slider rail 180).

Additionally, the CCU may translate in the X and Y directions a few millimeters and/or rotate about the X- and Y-axes between two and three degrees (2-3°). Upon being aligned, the CCU 200 may be secured in the X-tower 100 by the closure mechanism 150 returning the mounting frame 130 to the operating position.

Figure 8:
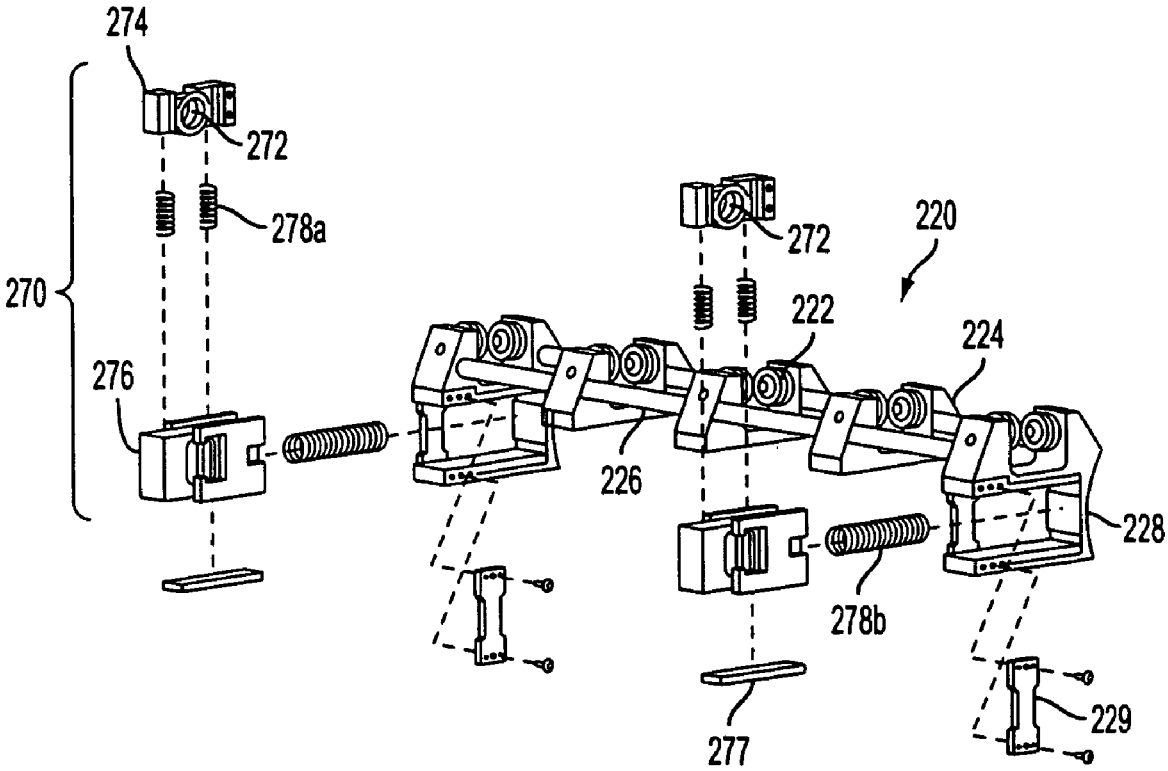
FIG. 8 shows an isometric exploded view of a roller assembly with magazine assemblies of the CCU.

FIG. 8 shows an isometric exploded view of the roller assembly 220 and the magazine assemblies 270. The wheels 222 of the roller assembly 220 are shown in five tandem opposing pairs and rotate in the Y-axis when aligned with the X-tower portion 100 and sliding along the slider rail 180.

The wheels 222 may be disposed in wheel housings 224 connected together by connection rods 226. The wheel housings 224 at either end of the roller assembly 220 may include recessed receivers 228 into which the magazine assemblies 270 may be inserted.

The magazine assemblies 270 may include pivot cases 274 that contain the pivot pins 272. Each pivot case 274 may be inserted into a corresponding magazine housing 276 suspended between a flat cage bearing 277 and lateral springs 278*a*. The magazine assemblies 270 may be inserted into the recessed receivers 228 and secured by corresponding axial springs 278*b* and retainer plates 229.

The CCU 200 requires close alignment with the photoreceptor belt 120. To achieve this result, the slider rail 180 supports the roller assembly 220, both while in operation as well as during installation and removal of the CCU 200 from the X-tower portion 100. The mounting frame 130 may be shifted in the X-direction away from the photoreceptor belt 120 to install the CCU 200 by rolling the roller assembly wheels 222 along the slider rail 180, thereby positioning the CCU 200 adjacent the rear plate 170.

The position of the CCU 200 may be adjusted for proper alignment in the X-tower portion 100 by pivoting the cradle assembly 260 joined with the roller assembly 220 by the magazine assemblies 270 along the X-, Y- and Z-axes. Accordingly, the bracket assemblies 250 may then be inserted into their corresponding docking blocks 160. Returning the mounting 130 to the operating position by moving the closure mechanism 150 closes the X-tower portion 100 and secures the CCU 200 in proper proximity to the photoreceptor belt 120.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An imaging media cartridge for a printing system, the imaging media cartridge comprising:

a housing having pivots along an alignment axis;

a roller that slides along a rail of the printing system and is disposed on the housing; and a bracket disposed on the housing, wherein the housing rotates on the pivots to insert the bracket into a dock of the printing system, wherein the alignment axis is substantially parallel to the rail.

2. The toner cartridge according to claim 1, wherein the housing rotates along at least one axis substantially orthogonal to the alignment axis.

3. The imaging media cartridge according to claim 1, wherein the roller includes at least a pair of wheel housings, each wheel housing having wheels that glide along the rail.

4. The imaging media cartridge according to claim 3, further including a pair of magazines that contains the pivots, wherein the pair of magazines is disposed in the corresponding pair of wheel housings, each magazine having a flat cage bearing.

5. The imaging media cartridge according to claim 1, wherein the bracket includes at least one wheel to glide into the dock.

6. A xerographic system, comprising:

a mounting frame disposed in one of an operating position and an open position displaced along an axial direction, the mounting frame including a rail having a mounting axis substantially orthogonal to the axial direction;

a dock disposed in association with a photoreceptor;

a removable imaging media cartridge, including:

a housing having pivots along an alignment axis;

a roller disposed on the housing, the roller sliding along the rail while the mounting frame is in the open position; and a bracket disposed on the housing, wherein the housing rotates on the pivots to insert the bracket into the dock while the mounting frame is in the operating position.

7. The xerographic system according to claim 6, wherein the alignment axis is substantially parallel to the mounting axis.

8. The xerographic system according to claim 6, wherein the housing rotates along at least one axis substantially orthogonal to the alignment axis.

9. The xerographic system according to claim 6, wherein the roller includes at least a pair of wheel housings, each wheel housing having wheels that glide along the rail.

10. The xerographic system according to 9, wherein the removable imaging media cartridge further includes a pair of magazines that contains the pivots, wherein the pair of magazines is disposed in the corresponding pair of wheel housings, each magazine having a flat cage bearing.

11. The xerographic system according to claim 6, wherein the rail includes a support beam and a flange, and the roller includes at least a pair of wheel housings, each wheel housing including a pair of tandem wheels facing each other, the tandem wheels gliding along the flange and between the support beam.

12. The xerographic system according to claim 6, wherein the bracket includes at least one wheel to glide into a recess of the dock.

13. A method of mounting an imaging media cartridge into a xerographic system, comprising:

moving a mounting frame from an operating position to an open position in an axial direction;

sliding the imaging media cartridge by a roller onto a rail disposed on the mounting frame along a mounting axis substantially orthogonal to the axial direction;

pivoting the imaging media cartridge on an alignment axis substantially parallel to the mounting axis;

returning the mounting frame from the open position to the operating position; and engaging a bracket on the imaging media cartridge to a dock as the mounting frame returns from the open position to the operating position.

14. The method of mounting an imaging media cartridge according to claim 13, further including rotating the imaging media cartridge along at least one axis substantially orthogonal to the alignment axis.

15. The method of mounting an imaging media cartridge according to claim 13, wherein sliding the imaging media cartridge further comprises gliding the roller on wheels along a flange supported by a central beam, the wheels being disposed on the roller, the flange and central beam being disposed on the rail.

16. The method of mounting an imaging media cartridge according to claim 13, wherein sliding the imaging media cartridge includes mounting wheels in wheel housings, and disposing the wheel housings in the roller, the wheels gliding along the rail.

17. The method of mounting an imaging media cartridge according to claim 16, wherein pivoting the imaging media cartridge includes mounting pivots to magazines, and disposing the magazines in the wheel housings contained in the roller.

18. The method of mounting an imaging media cartridge according to claim 13, wherein engaging the bracket includes gliding a wheel into a recess of the dock.

19. The method of mounting an imaging media cartridge according to claim 13, wherein moving and returning the mounting frame further includes sliding the mounting frame by a mechanism.

* * * * *